US011525620B2

(12) United States Patent
Claass et al.

(10) Patent No.: US 11,525,620 B2
(45) Date of Patent: Dec. 13, 2022

(54) DOOR INSERT, DOOR OF A HOUSEHOLD COOLING APPLIANCE, AND METHOD FOR MOUNTING A DOOR INSERT

(71) Applicant: BSH HAUSGERAETE GMBH, Munich (DE)

(72) Inventors: Elena Claass, Geislingen (DE); Denis Lux, Heidenheim (DE); Andrea Fink, Gerstetten (DE); Andreas Gatter, Gerstetten (DE)

(73) Assignee: BSH HAUSGERAETE GMBH, Munich (DE)

( * ) Notice: Subject to any disclaimer, the term of this patent is extended or adjusted under 35 U.S.C. 154(b) by 5 days.

(21) Appl. No.: 16/737,435

(22) Filed: Jan. 8, 2020

(65) Prior Publication Data

US 2020/0284498 A1 Sep. 10, 2020

(30) Foreign Application Priority Data

Mar. 5, 2019 (CN) ..... 201910163821.X

(51) Int. Cl.

| | |
|---|---|
| ***F25D 23/04*** | (2006.01) |
| ***F25D 23/02*** | (2006.01) |
| ***F25D 23/06*** | (2006.01) |
| ***F25D 25/02*** | (2006.01) |

(52) U.S. Cl.

CPC ..... *F25D 23/04* (2013.01); *F25D 23/025* (2013.01); *F25D 23/028* (2013.01); *F25D 23/067* (2013.01); *F25D 25/02* (2013.01); *F25D 2323/023* (2013.01)

(58) Field of Classification Search

CPC ..... F25D 23/025; F25D 23/028; F25D 23/04; F25D 23/067; F25D 25/02; F25D 2323/02; F25D 2323/023; F25D 2325/00

See application file for complete search history.

(56) References Cited

U.S. PATENT DOCUMENTS 2,746,828 A * 5/1956 Amore ..... F25D 23/04 312/405.1
2,840,433 A * 6/1958 Richard ..... F25D 23/04 312/405.1

(Continued)

FOREIGN PATENT DOCUMENTS

CN 103477170 A 12/2013
CN 104729181 A 6/2015

(Continued)

*Primary Examiner* — Andrew M Roersma
(74) *Attorney, Agent, or Firm* — Laurence A. Greenberg; Werner H. Stemer; Ralph E. Locher

(57) ABSTRACT

A door insert for a door of a household cooling appliance has a body defining a storage space for storing goods. The insert body has a bottom and side walls. A front wall, which is formed as a separate component, extends in a width direction between the side walls. A separate holding bracket connects the separate component to at least one of the side walls. The outer face of a side wall is provided with a coupling structure and a bracket element of the separate holding bracket is formed with a counter coupling structure. The two coupling structures are engaged with each other. There is also described a door, a household cooling appliance, and a method for mounting a door insert in a door.

14 Claims, 10 Drawing Sheets

(56) References Cited

U.S. PATENT DOCUMENTS

| | | | | | |
|---|---|---|---|---|---|
| 3,029,953 | A * | 4/1962 | Morrissey, Jr. | F25D 23/04 | 312/321.5 |
| 3,227,502 | A * | 1/1966 | Roberts | F25D 23/04 | 312/405.1 |
| 3,402,907 | A * | 9/1968 | Fisher | F25D 23/067 | 248/222.11 |
| 3,628,762 | A * | 12/1971 | Williams | F25D 23/04 | 248/235 |
| 3,652,032 | A * | 3/1972 | Eros | F25D 23/04 | 248/235 |
| 4,815,685 | A * | 3/1989 | Roberts | F25D 23/04 | 24/297 |
| 5,226,717 | A * | 7/1993 | Hoffman | A47B 96/02 | 211/153 |
| 8,752,918 | B2 | 6/2014 | Kang | | |
| 9,170,045 | B2 * | 10/2015 | Oh | F25D 25/027 | |
| 9,518,777 | B2 | 12/2016 | Lee et al. | | |
| 9,879,901 | B2 | 1/2018 | Lim | | |
| 10,174,992 | B2 * | 1/2019 | Rotter | F25D 25/02 | |
| 2012/0297816 | A1 * | 11/2012 | Czach | F25D 23/04 | 62/377 |

FOREIGN PATENT DOCUMENTS

| | | | | | |
|---|---|---|---|---|---|
| CN | 105987559 | A | | 10/2016 | |
| CN | 107024054 | A | | 8/2017 | |
| CN | 207095123 | U | | 3/2018 | |
| CN | 207999987 | U | | 10/2018 | |
| FR | 2405385 | A1 | * | 5/1979 | F25D 23/04 |
| GB | 867218 | A | * | 5/1961 | F25D 23/04 |
| JP | S-6186579 | A | * | 5/1986 | F25D 23/04 |
| JP | 2760652 | B2 | | 6/1988 | |
| JP | H-04165281 | A | * | 6/1992 | F25D 23/04 |
| KR | 20080089775 | A | * | 10/2008 | F25D 23/04 |
| KR | 20130015988 | A | | 2/2013 | |
| KR | 20140019908 | A | * | 2/2014 | F25D 23/04 |

* cited by examiner

DOOR INSERT, DOOR OF A HOUSEHOLD COOLING APPLIANCE, AND METHOD FOR MOUNTING A DOOR INSERT

CROSS-REFERENCE TO RELATED APPLICATION

This application claims the priority, under 35 U.S.C. § 119, of Chinese patent application CN 2019 101 638 21, filed Mar. 5, 2019; the prior application is herewith incorporated by reference in its entirety.

BACKGROUND OF THE INVENTION

Field of the Invention

The invention relates to a door insert for a door of a household cooling appliance. Moreover, the invention also relates to a door for a household cooling appliance, a household cooling appliance, and a method for mounting a door insert.

Korean publication KR 2013 0015988 discloses a household cooling appliance that has a door device comprising two doors. The doors are pivotable about a common axis, wherein they can be pivoted independently of each other as well as pivoted jointly. In the rear door a storage compartment is formed, which is closable by the front door. The entire door device closes a receptacle for food items that is separate from the storage compartment of the door device and is a cooling compartment. On an inner face of the front door, which faces the rear door, door trays are arranged. Furthermore, door trays are arranged on the rear door. The second door is bounded towards the rear by a wall that is transparent and in turn comprises a pivotable flap element itself.

In the known prior art an inner door wall is formed as pivotable, transparent sheet, on which however no further components are arranged.

Moreover, it is also known that an inner door wall can comprise vertically oriented door pillars, at which door trays can be attached. Such door pillars, however, are configured to be relatively massive and large so that they also require corresponding construction space. Further, in this case, it is solely possible to arrange a door tray by connecting the door tray to the each of the two door pillars. Accordingly, the existence of such door pillars is required. Commonly also several door trays are attached to such door pillars. Thus, these door pillars must be dimensioned to be relatively large in order to provide corresponding holders.

Door trays are known in multiple embodiments. For instance it is known that a door tray viewed per se is configured as trough-shaped body, into which food items can be placed. Equally, it is known that door trays are formed as compartments of several components, wherein here a bottom is given, upon which the food items can be put. In these embodiments it may also be envisaged that there is no body that is trough-shaped, when viewed as such, and comprises side walls that extend directly from the bottom and reach upward, but rather between a bottom and a further component bounding the volume space of the door tray a slot is formed. This further bounding component can form a front wall of the door tray and is connected with the further components of the door tray. Such components of this further component, however, are limited with regard to permanent position security as well as with regard to mechanical load capacity.

SUMMARY OF THE INVENTION

It is the object of the present invention to provide a door tray or door insert for a door of a household cooling appliance.

With the above and other objects in view there is provided, in accordance with the invention, a door insert for a door of a household cooling appliance, the door insert comprising:

a body defining a storage space for storing goods, said body having a bottom and side walls;

at least one front wall extending in a width direction between said side walls, said at least one front wall being a separate component; and at least one separate holding bracket connecting said separate component to at least one of said side walls.

In other words, the door insert according to the invention has a body. The body bounds a storage space for storing goods. In other words, the body defines a storage space for storing goods. The body comprises a bottom, side walls, and a front wall. According to an embodiment, the body may comprise two side walls, in particular a left side wall and a right side wall. The body may further comprise a rear wall. The body may further comprise a top wall. According to an embodiment, bottom, the side walls, the top wall and the rear wall of the body are integrally formed. The front wall is configured as a separate component. In other words, the front wall is not integrally formed with the bottom and side walls. In particular, the front wall may be releasably connected and/or non-destructively connected to the side walls. This front wall is a separate component. In particular, the front wall may be flat rod or a rail. The front wall extends between the side walls of the body. The front wall may solely be connected to the side walls of the body. In other words, the front wall is not connected to the bottom of the body. The door tray comprises at least one separate holding bracket. The front wall is connected to at least one side wall of the body by the at least one separate holding bracket. In particular, the wording "separate" means a configuration, wherein a component is not integrally formed with another component, but by connecting two components to each other by form fit and/or frictional connection.

According to an embodiment, the front wall may be connected to each of the two side walls, wherein for each connection to the side walls one separate holding bracket is applied.

According to an embodiment, more than one front wall is connected to the body. According to an embodiment, several front walls are connected to the body. According to an embodiment, the front walls are arranged on upon the other in a height direction of a household cooling appliance. According to an embodiment, the front walls are spaced from each other.

By such a design a multi-part door insert is facilitated, in which a very individual design of the door insert is achieved. Thus, the front wall is attachable in a manner of improved mounting. A particularly stable arrangement fixed in position is achieved. The front wall represents a component of the door insert, which represents a front support and bounds the storage space or the volume of the door insert at the front side. The front wall is important to catch stored goods in the storage space tilting forward, if applicable, so that in this case also a corresponding force impact upon a front wall can occur. By implementing the front wall and the separate holding bracket, a stable and simple connection is achieved.

According to an embodiment, the front wall may be a separate bar or a separate rail or a separate board. The front wall may be configured to be straight-lined. In particular, the front wall, viewed in the height direction of the door insert, may be arranged spaced apart from the bottom and without contacting the bottom. At the front side, the door insert may be designed in such a way that between the bottom and the front wall an air space is formed. In other words, a clearance exists between the front wall and the bottom. The clearance may provide access to the interior of the door insert, i.e. access to the storage space is provided. According to an embodiment, if several front walls are provided, the bottom and the lowest front wall form a clearance, wherein the lowest front wall with its neighboring front wall also forms a clearance, and so on.

According to an embodiment, the at least one side wall may comprise a through hole. According to an embodiment, the at least one separate holding bracket may be plugged in the through hole. According to an embodiment, the at least one separate holding bracket may be partly inserted into a hollow section of the front wall. In other words, the separate holding bracket may be passed through the through hole so that in the mounted final state of the door insert, the separate holding bracket may extend on both sides of the side wall. On the one hand, thereby the separate holding bracket may be retained in a specific position on the side wall itself. On the other hand, in view of assembling, the separate holding bracket may also be specifically guided into its end positions by the through hole. At the location of the through hole, the separate holding bracket may circumferentially entirely surrounded by the side wall. According to an embodiment, the through hole may be configured as gap or slot. Thus, the separate holding bracket may be relatively accurately passed through the through hole.

Moreover, by such a design construction space may be saved, in particular in the depth direction of the door insert. The separate holding bracket does not project in the depth direction beyond the dimensions of the side wall towards the front or towards the back. The through hole may be configured as circumferentially closed slot or gap.

According to an embodiment the separate holding bracket may comprise a first bracket element. The first bracket element may contact the outer face of the side wall.

Each of the side walls comprises an inner face directed to the storage space and an outer face directed to the opposite direction of the inner face.

In other words, in the mounted end state of the separate holding bracket, the separate holding bracket may contact an outer wall of the side wall facing away from the other side wall. Thereby the separate holding bracket may be supported by a specific partial portion of the outer face of the side wall, so that the separate holding bracket may be in contact with a large surface area of the side wall. Thereby, a high position accuracy of the separate holding bracket may be easily and permanently achieved.

According to an embodiment, the separate holding bracket may comprise a second bracket element. According to an embodiment, the first bracket element and the second bracket element may be arranged to enclose an angle of between 80° and 100°, further preferably 90°. The second bracket element may be plugged in the through hole and may be inserted in the hollow section of the front wall.

In other words, the second bracket element may extend at an angle of between 80° and 100°, in particular 90°, relative to the first bracket element and ends in the first bracket element. The second bracket element may extend through the through hole in the direction of the opposite side wall. By such a design it may be achieved that the separate holding bracket may be very specifically arrangeable on the side wall. The first bracket element may be oriented essentially in parallel to the side wall, whereas the second bracket element may be oriented essentially perpendicular thereto. Thereby besides a fit of the separate holding bracket securely fixed in position on the side wall, it may also be achieved that by the second bracket element a blade-like coupling element for coupling with the front wall that is configured as a rib is facilitated. The second bracket element may be arranged to be oriented in the direction of the longitudinal axis of the front wall and thus extends in the same direction as the front wall. Thus, a stable coupling of the front wall with the separate holding bracket may be facilitated. This coupling may be then also realizable in a space-saving manner.

According to an embodiment, the outer face of a side wall may be provided with a coupling structure. According to an embodiment, the first bracket element of the separate holding bracket may be provided with a counter coupling structure. According to an embodiment, the coupling structure and the counter coupling structure may be engaged with each other.

In other words, on an outer face of the side wall of the body a coupling structure is formed, which may be coupled with a counter-coupling structure formed on the holding bracket, in the mounted end state of the separate holding bracket on the side wall. Thus, an improved fixing of the holding bracket in position, in particular of the first bracket element on the side wall, in particular on this outer face, may be achieved. According to an embodiment, the coupling structure and the counter-coupling structure may be configured in such a way that they engage in the coupled state. Thereby a particularly stable coupling may be achieved.

According to an embodiment, the coupling structure may comprise at least two separate coupling elements.

According to an embodiment, the at least two coupling elements may be integrally formed on the side wall. According to an embodiment, the at least two coupling elements are formed distant from each other.

In other words, the coupling structure may comprise at least two separate coupling elements, which may be formed as a single piece with the outer wall of the side wall. According to an embodiment, thereby the mechanical coupling may be once again improved and stabilized.

According to an embodiment, these two coupling elements may be of a geometrically different design. Thus, a mounting coding may be facilitated, such as a poka yoke effect. According to an embodiment, at least one coupling element may have a square profile or circular cross section. In particular, the at least one coupling element may be formed as a protrusion having a rectangular circumference. Additionally, the at least one coupling element may be formed as a hollow profile. According to an embodiment, at least one further coupling element may have a circular profile or circular cross section. In particular, the at least one further coupling element may be formed as a protrusion having a circular circumference. Additionally, at least one coupling element may be formed as a hollow profile. In particular, each coupling element may be formed as a hollow profile.

According to an embodiment, the counter coupling elements may have a shape design that is complementary to the coupling elements. According to an embodiment, thereby a particularly stable and accurate fitting of the coupling may be achieved.

According to an embodiment, the counter coupling structure may be two openings. According to an embodiment, the two coupling elements may project beyond the openings in the direction perpendicular to the face of the side wall, in case the separate holding bracket is mounted to the side wall and to the front wall.

According to an embodiment, the front wall at least at its end facing the separate holding bracket may be configured as hollow profile. Thus, the front wall may be configured to be reduced in weight. On the other hand, by such a design also a very specific coupling with the separate holding bracket may be facilitated. According to an embodiment, the separate holding bracket in the mounted end state at the end side may be plugged into the hollow profile of the front wall. Thus, a stable mechanical coupling may be achieved. Moreover, a space-saving coupling between the two components may be provided.

According to an embodiment, the second bracket element may comprise a clamping element. According to an embodiment, the clamping element may be integrally formed with the second bracket element as a single piece. According to an embodiment, the camping element may be inserted into the hollow profile of the front wall, in case the separate holding bracket is mounted to the front wall.

In other words, the second bracket element being configured to be inserted into the hollow profile of the front wall may comprise a clamping element. According to an embodiment, a coupling being securely fit in position and stable may be facilitated thereby. In particular by such a design a very simple and permanently reliable coupling effect may be achieved. According to an embodiment, a coupling may be automatically achieved by sliding the second bracket element into the hollow profile of the front wall. According to an embodiment, no further mounting step may be required, in order to achieve a clamping effect.

According to an embodiment, the clamping element may be integrally formed with the bracket element, in particular the second bracket element of the separate holding bracket. Thus, the separate holding bracket may be configured as a single component.

According an embodiment, the clamping element may be a spring element. According to an embodiment, the spring element may project from a main plane of the second bracket element. According to an embodiment, the spring element may be provided by a cutting-out portion of the second bracket element, wherein the cutting-out portion is bent, in order to protrude from the main plane of the second bracket element.

In other words, the spring element may project from the plane of this bracket element of the separate holding bracket. According to an embodiment, a certain deformation elasticity or movement elasticity of the spring element may be achieved, wherein a clamping is easily achieved upon insertion of the bracket element into the hollow profile of the front wall.

According to an embodiment, the spring element may be produced by embossing and/or stamping and/or cutting a portion of the second bracket element of the separate holding bracket.

According to an embodiment, the front wall may be an extruded metal profile. In particular, the front wall may be configured as extruded aluminum profile.

According to an embodiment, the body may be formed as a frame including a bottom, two side walls, a top wall and the front wall, wherein the front wall is connected a separate component to the side walls.

According to an embodiment, the body may be arranged as trough standing in the height direction. This means that its trough bottom extends in the plane extending through the width direction and the height direction.

A further aspect of the invention relates to a door for a household cooling appliance with a door insert according to the above-named aspect or an advantageous design thereof.

According to an embodiment, the door insert comprises the body, wherein the body is a frame inserted into an opening or recess of the door, wherein several front walls are connected to the side walls of the body. According to an embodiment, the door insert comprises at least two front walls, at least three front walls. According to an alternative embodiment, the door insert comprises between 2 to 6 front walls. According to an embodiment the body is a trough-shaped, i.e., through-like, insert.

According to an embodiment, the door is a door device, the door device comprising an inner door and an outer door, wherein the outer door is arranged in front of the inner door in a closed state of the doors and wherein the frame is inserted into an opening or recess of the inner door.

The outer door can be pivoted relative to the inner door. In a coupled state of the doors the outer door is motion-coupled with respect to the inner door and is jointly pivotable with the inner door. In the coupled state both doors can be pivoted about a common rotation axis.

In the inner door a storage space for food items can be formed, in which the door insert is formed. The storage space at the front side has an access opening, which is openable and closable by the outer door.

A further aspect of the invention relates to a household cooling appliance with a door insert according to the above-named aspect or an advantageous embodiment thereof. The household cooling appliance additionally or instead can comprise a door according to the above-named aspect or an advantageous embodiment thereof.

According to an embodiment, the household cooling appliance comprises a housing, in which at least one compartment for food items is configured.

According to an embodiment the household cooling appliance may have a door device according to the above-named aspect or an advantageous embodiment thereof. The door device may be pivotably arranged on the housing and provided for closing the compartment.

According to an embodiment, the compartment may be a cooling compartment. Alternatively, the compartment may however also be a freezer compartment. According to an embodiment, the household cooling appliance may comprise at least two separate compartments for food items, one of which may be a cooling compartment and the other may be a freezer compartment. According to an embodiment, these compartments may be configured to be one above the other in the height direction of the household cooling appliance. Exemplarily, a top compartment may be closable by two separate doors, which are pivotable about separate vertical axes, wherein the vertical axes extend in parallel to each other, however, arranged at opposite sides of the housing, viewed in the width direction. Such two doors for closing the compartment may be pivotable independently of each other and, viewed in the width direction, arranged adjacent to each other without overlapping. In the height direction these two doors may be arranged at the same height level. In the closed state of the two doors, the two doors may extend in one plane relative to each other that extends through the width direction and the height direction without overlapping.

According to an embodiment, at least one of these two doors, which close this compartment, may be configured as a door device according to the above-named aspect or an advantageous embodiment thereof. According to an embodiment, the further compartment may be closable by a further separate door. This further door may be a front wall of a drawer that may be pushed in and drawn out linearly in the depth direction.

A further aspect of the invention relates to a method for mounting of the door insert for a door of a household cooling appliance. A body of the door insert may be provided, wherein by the body a storage space for stored goods of the door insert may be formed. The body may be configured to comprise a bottom, side walls, and a front wall. The front wall may be provided as a separate component, which may be arranged to extend beyond the side walls. The separate component may be attached by at least one separate holding bracket to the side wall.

According to an embodiment, the separate holding bracket with a first bracket element may be attached to an outer face of the body. According to an embodiment, a coupling structure may be formed, which may be coupled with a counter coupling structure that may be formed on the separate holding bracket in particular the first bracket element. A second bracket element of the separate holding bracket, which may extend at an angle, in particular between 80° and 100°, relative to the first bracket element, coming from the outer face of the side wall may be pushed through a through hole in the side wall. This may be effected until the first bracket element is coupled to the outer face of the side wall. The second bracket element may be inserted into a hollow profile of the front wall, which may be formed at least at one end of the front wall. In other words, the second bracket element may be plugged into the interior of the hollow profile. The hollow profile may be configured to be open at the end of the front wall directed to the side wall, so that the second bracket element may be plugged via the narrow edge of the front wall into the hollow profile of the front wall. According to an embodiment, the front wall may be configured in such a way that in a plane perpendicular to the longitudinal axis of the front wall the hollow profile may be completely circumferentially closed. According to an embodiment, the hollow profile may be configured as multi-chamber hollow profile.

According to an embodiment, this second bracket element of the holding profile may comprise a clamping element. According to an embodiment, upon inserting the second bracket element into the hollow profile by the clamping element, a clamping force may be applied, with which the second bracket element may be retained in the hollow profile, and thus may be retained fixed in position.

One aspect of the invention relates to a door tray for a door of a household cooling appliance. The door tray may comprise a trough-shaped, or troughlike container for receiving food items. The door tray may be configured in such a way that the trough-shaped container may be illuminated. The trough-shaped container may comprise a hollow space for coupling light and for scattering the light. According to an embodiment, the door tray itself may comprise an integrated hollow chamber, which may be designed in such a way that light of a light source may couple light into the hollow space or may illuminate the hollow space. According to an embodiment, additionally, the light may be scattered based on the geometry of the hollow space. According to an embodiment, the hollow space may be arranged below the bottom area of the trough-shaped container. According to an embodiment, the hollow space may be alternatively or additionally be arranged at a rear side of the trough-shaped container. According to an embodiment, the hollow space may be alternatively or additionally arranged at a front side of the trough-shaped container. According to an embodiment, the light source may be arranged at a wall, at which the trough-shaped container is arranged. According to an embodiment, the hollow space may comprise a coupling opening configured to couple light of the light source directly into the hollow space.

According to an embodiment, the light source may be positioned external to the door tray and/or internal to the door tray. According to an embodiment, the light source may be arranged to be protected and safeguarded against outer influences, such as food items positioned in the trough-shaped container or other influences or components.

According to an embodiment, the hollow space may serve as an optical component, in order to facilitate a good irradiation or illumination. According to an embodiment, the illumination or irradiation may be provided via a light source that may be indirectly arranged, and thus may not be directly arranged within the volume of the trough-shaped container. In other words, the light source may be arranged external to the inner volume of the trough-shaped container.

According to an embodiment, the hollow space may be integrally formed on the trough-shaped container. According to an embodiment, trough-shaped container including the hollow space forms a single piece. According to an embodiment, the fixing in position between the hollow space and the trough-shaped container may be defined.

According to an embodiment, the hollow space may be formed under a bottom of the trough-shaped container. According to an embodiment, a uniform coupling of light into the volume of the trough-shaped container via the bottom may be achieved.

According to an embodiment, the door tray may be formed as a single piece with the hollow space.

With the indications "top," "bottom," "rear," "horizontal," "vertical," "depth direction," "width direction," "height direction" etc. the positions and orientations given with intended use and intended arrangement of the door device or the device are indicated.

Further features of the invention are apparent from the claims, the figures and the description of figures. The features and feature combinations mentioned above in the description as well as the features and feature combinations mentioned below in the description of figures and/or shown in the figures alone are usable not only in the respectively specified combination, but also in other combinations or alone without departing from the scope of the invention. Thus, implementations are also to be considered as encompassed and disclosed by the invention, which are not explicitly shown in the figures and explained, but arise from and can be generated by separated feature combinations from the explained implementations. Implementations and feature combinations are also to be considered as disclosed, which thus do not have all of the features of an originally formulated independent claim.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

In the figures identical or functionally identical elements are equipped with the same reference signs.

DETAILED DESCRIPTION OF THE INVENTION

Figure 1:
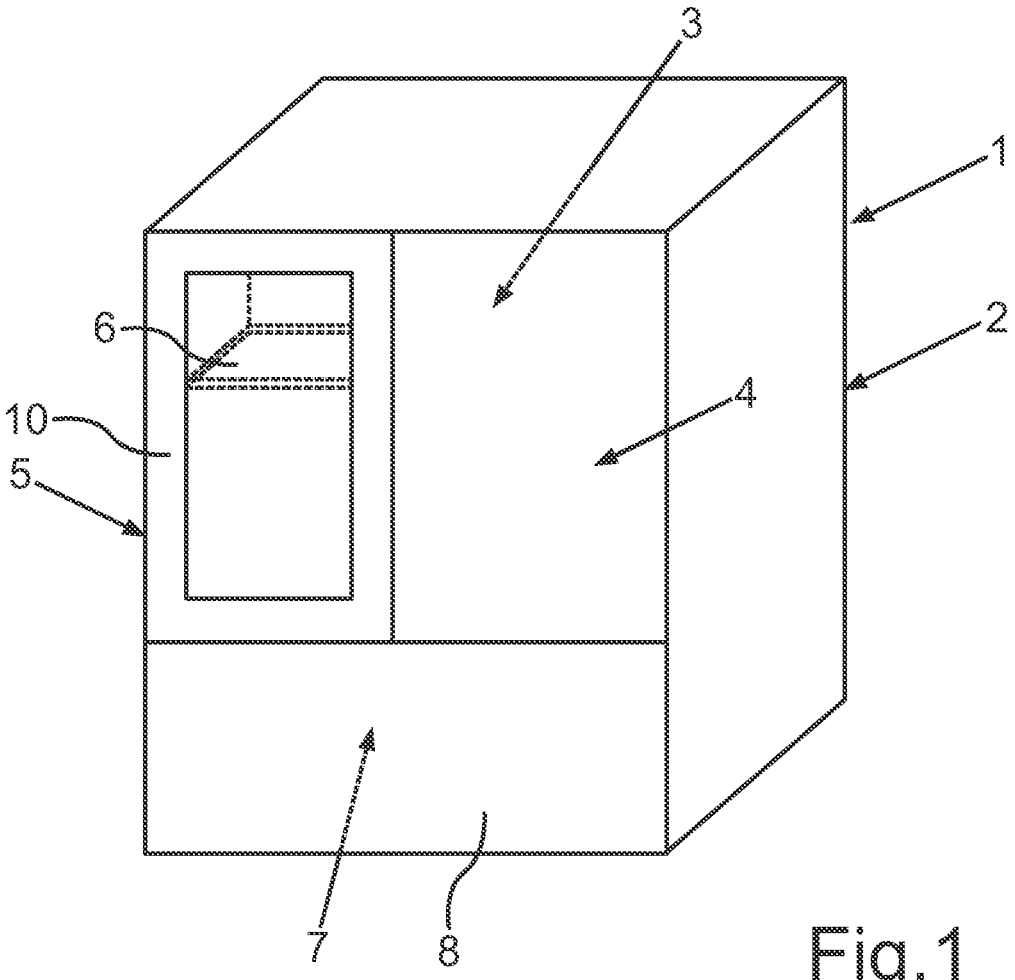
FIG. 1 a perspective view of an embodiment of a household cooling appliance.

Referring now to the figures of the drawing in detail and first, particularly, to FIG. 1 thereof, there is shown a schematic view of an embodiment of a household cooling appliance 1, which for instance may be a cooling device or a freezer device or a fridge-freezer combination device. A household cooling appliance 1, which is configured for storing and preserving food items, comprises a housing 2, in which at least one compartment for food items is formed. The household cooling appliance 1 comprises a compartment 3, which may be a cooling compartment.

Moreover, the household cooling appliance 1 comprises a door 4, which is pivotally mounted to the housing 2. The door 4 is configured to at least partly open or close the compartment 3 on the front side. The door 4 is also referred to as a first door, in order to be able to distinguish the different doors from each other.

In the case of the embodiment of FIG. 1, the compartment 3 is at least partly openable and closable by a further separate door, which is arranged in the width direction (x direction) adjacent to the door 4 and in the height direction (y direction) at the same height thereto. The further door in the embodiment is a door device 5. The door device 5 comprises at least two separate doors, namely an inner door 9 and an outer door 10. The door device 5 comprises a storage space 11, which is formed between the inner and outer doors 9, 10. In the storage space 11 at least one door tray 6 is formed, which in particular may be configured for receiving bottles.

Moreover, the household cooling appliance 1 comprises a further compartment 7 for food items, which is separate from the compartment 3 and may be a freezer compartment. The further compartment 7 is openable and closable by a door 8 that is separate therefrom. The door 8 is also named as second door, in order to be able to distinguish the different doors from each other. The second door 8 may be a front wall of a drawer, which can be pushed in and drawn out in the linear direction and thus in the depth direction (z-direction). In the closed state the first door 4 and the second door 8 as well as the door device 5 are arranged in the same plane relative to each other and represent front side visible components or outer components of the household cooling appliance 1.

The first door 4 and the second door 8 as well as the door device 5 are operable independently of each other. For accessing the compartment 3 the first door 4 and the door device 5 can be opened or only one of the two components. The first door 4 and the door device 5 each are pivotable about vertical axes.

According to an alternative embodiment of a household cooling appliance, not shown in the figures, a household cooling appliance may comprise only a single compartment, wherein this compartment may be openable and closable by doors, as the first door 4 and the door device 5 of FIG. 1. In a further, alternative embodiment, not shown in the figures, a household cooling appliance may comprise a compartment, wherein the compartment is comparable to compartment 3 of FIG. 1 and is solely openable and closable by a door device 5. In this case, no further door, such as the first door 4 of FIG. 1, is provided. In a further alternative embodiment, not shown in the figures, a household cooling appliance may be comprise two compartments, such as the compartment 3 and the further compartment 7 of FIG. 1, wherein the compartment comparable to the compartment 3 is openable and closable solely by a door, such as the door device 5.

Figure 2:
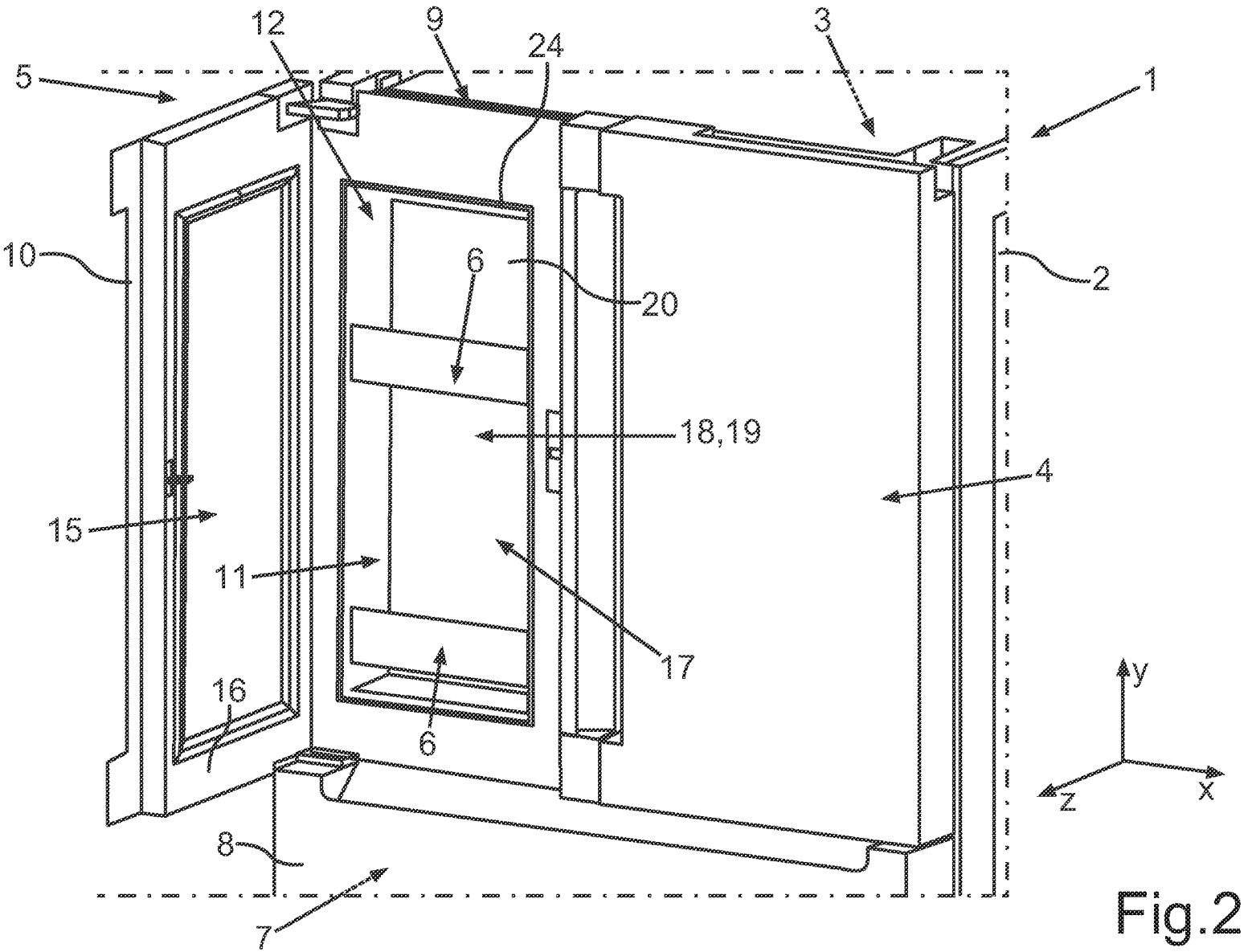
FIG. 2 a perspective view of a partial portion of an embodiment of a door device.

With reference to FIG. 2, the door device 5 comprises the inner door 9 and outer door 10. According to this embodiment, the inner door 9 and the outer door 10 are pivotable about a common vertical axis. The inner door 9 and the outer door 10 are pivotable independently from each other. The inner and the outer doors 9, 10 may be coupleable to each other. If the inner and the outer doors 9, 10 are coupled to each other, a user can pivot the inner and the outer doors 9, 10 together at the same time. In this case, the inner and the outer doors 9, 10 are in a coupled state. If the inner and the outer doors 9, 10 in a non-coupled state, a user may pivot the inner and the outer doors 9, 10 independently from each other. In this case, the inner and the outer doors 9, 10 are in a non-coupled state.

The outer door 10 represents a front side component and in a closed state covers the inner door 9, wherein the inner door 9 is arranged between the outer door 9 and the compartment 3. In other words, the inner door 9 lies behind the outer door 10 in the depth direction. If the inner door 9 and the outer door 10 are coupled with each other, the inner door 9 and the outer door 10 are motion-coupled. This means that the entire door device 5 may be jointly pivoted. In this case, the door device 5 may be pivoted about a single vertical axis. Thus, a user may access the compartment 3 by actuating or pivoting the door device 5. If the outer door 10 of this door device 5 is activated and thus pivoted independently from the inner door 9, access to the storage space 11 can be achieved. For instance, the storage space 11 may be configured as bottle storage space. In particular, the storage space 11 is arranged as a recess in the inner door 9. The storage space 11 is accessible from the front side, when the outer door 10 is opened relative to the inner door 9. This may be achieved in both cases, namely when the access to the compartment 3 is open or closed by the inner door 9.

Figure 3:
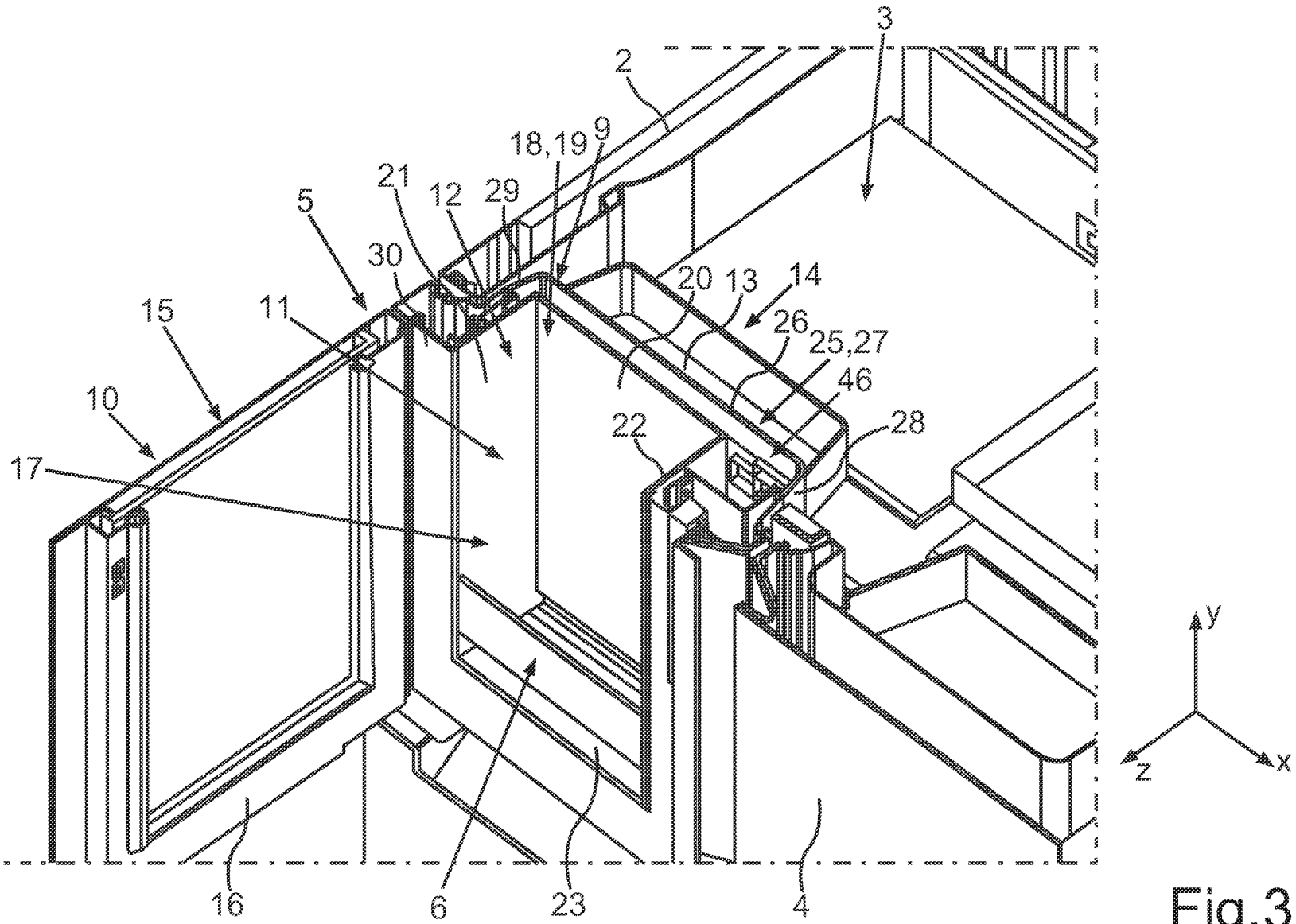
FIG. 3 a perspective view of a horizontal sectional view of the door device according to FIG. 2.

FIG. 3 is a perspective view of a horizontal section of the household cooling appliance 1. The storage space 11 is bounded by an insert 12.

According to an embodiment, the insert 12 may be a separate component.

The insert 12 may define the storage space 11 at least laterally, towards the back, towards the top, and towards the bottom. In other words, the insert 12 is of a trough-shaped design. FIG. 3, in which the sectional plane is in the horizontal plane and thus in x-z plane, shows a bottom or bottom wall 23. According to this embodiment, the bottom wall 23 forms the bottom of a lower door tray 6. The door tray 6 is integrated in the storage space 11.

FIG. 3 shows an inner face 13 of the inner door 9. The inner face 13 is directed to the compartment 3. According to this embodiment, a further door tray 14 is arranged. The further door tray 14 may be a conventional door tray. The further door tray 14 may not be accessible for a user, if the inner door 9 is closed.

FIG. 3 shows the outer door 10 in an opened state, so that a user may have access to the storage space 11. In a configuration, where the inner door 9 is closed and the outer door 10 is opened, a user may have no access to the compartment 3.

According to an embodiment, the outer door 10 may be at least partially transparent. For this purpose the outer door may have at least one viewing pane 15. A user may be able to look through the outer door 10 into the insert 12, when the outer door 10 is in a closed state. According to this embodiment, the outer door 10 may comprises a frame 16, which circumferentially encloses the at least one viewing pane 15. The viewing pane 15 may be a pane package and/or may comprise insulation glass.

Figure 4:
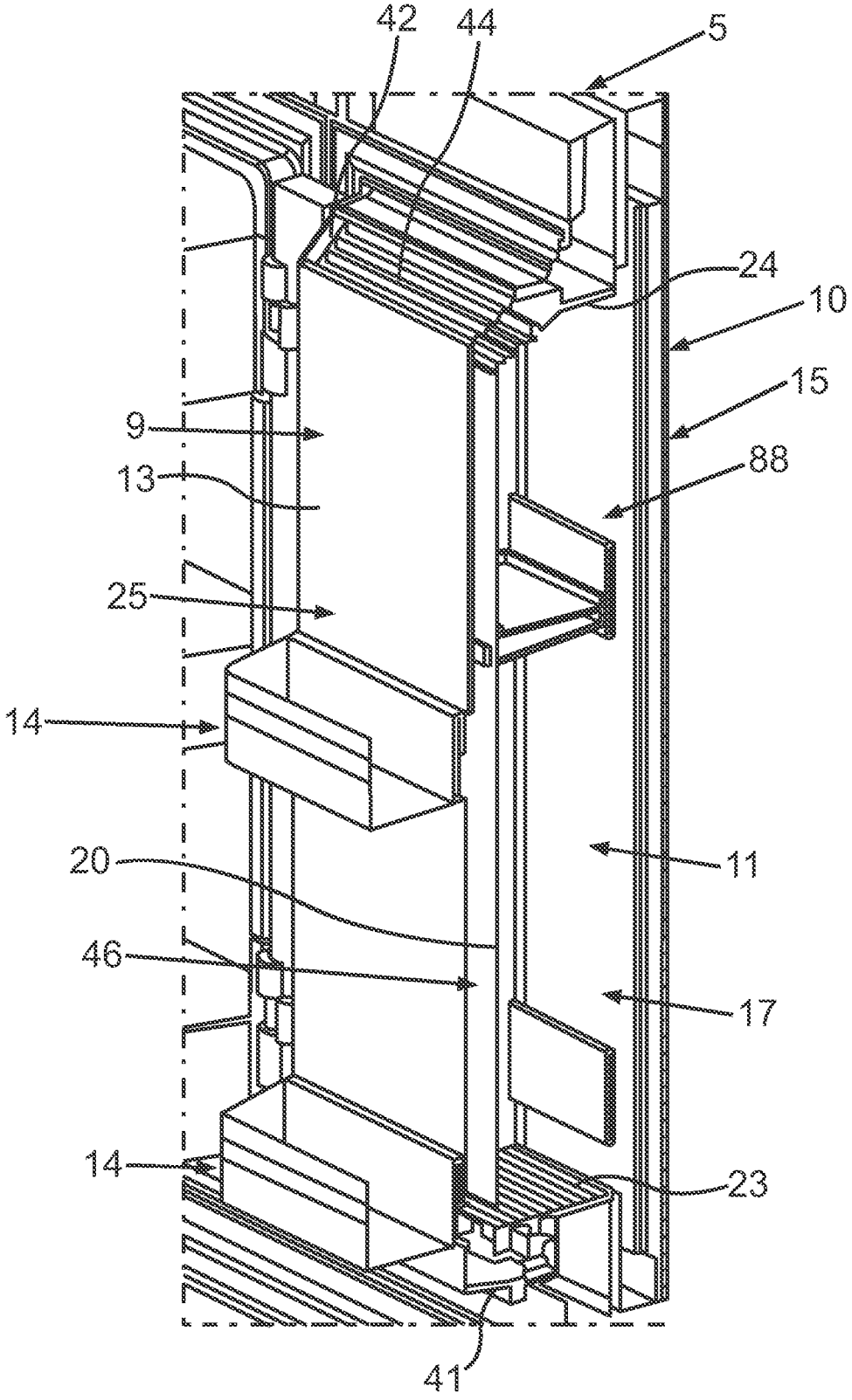
FIG. 4 a perspective vertical sectional view through a partial portion of the door device.

FIG. 4 shows a perspective vertical sectional view of the household cooling appliance 1 according to FIG. 1 in the area of the door device 5. FIG. 4 shows a state, in which the inner door 9 and the outer door 10 are coupled to each other, i.e. in a coupled state, and wherein the compartment 3 is accessible. In this case, the inner door 9 is in an opened state in relation to the compartment 3. In other words, the situation is a coupled-open state, where the inner and outer doors 9, 10 are in a coupled state and at the same time the inner door 9 is in an opened state in view of the compartment 3.

If the inner door 9 and the outer door 10 are coupled to each other, i.e. in a coupled state, and wherein the inner door 9 is closed in relation to the compartment 3 (i.e. the compartment 3 is inaccessible), in this case, a coupled-closed state is provided.

In other words, in the closed state of the inner door 9 in relation to the compartment 3, the outer door 10 may be opened in relation to the inner door 9, and thus solely the storage space 11 is accessible for a user. This situation of is shown in FIG. 3, which represents a non-coupled-closed state.

Again, if access to the compartment 3 is required, the entire door device 5, i.e. the motion-coupled inner and outer doors 9 and 10 have to be pivoted. In this case, also access to the further door trays 14 is provided. This situation represents a coupled-open state.

As can be seen in FIG. 2 to FIG. 4, the storage space 11 has a front side access opening 17, which is openable and closable by the outer door 10.

The door device 5, as can equally be seen in FIG. 2 to FIG. 4, comprises a trough-shaped door body 18. The trough-shaped door body 18 is configured in particular as a single piece. The trough-shaped door body 18 may be formed from plastic and/or metal. The trough-shaped door body 18 may be an injection-molded component. In the present embodiment, the insert 12 is formed by the wall body 18.

The trough-shaped door body 18, which can also be referred to as body 19, is vertically oriented. This means that it is positioned upright in its trough shape and the trough opening is oriented towards the front. The trough-shaped door body 18 also is accessible via the access opening 17.

The trough-shaped door body 18 may have a rear wall 20. The rear wall 20 may represent a trough bottom. The rear wall 20 is vertically oriented and thus extends in the x-y plane.

Figure 13:
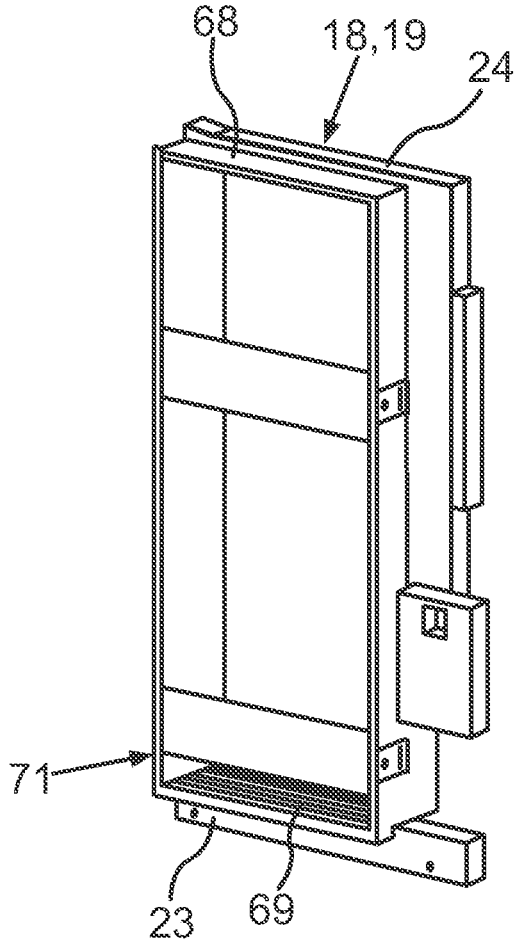
FIG. 13 a perspective view of a trough-shaped wall body, as it can be installed in a door device.

Moreover, the trough-shaped door body 18 has side walls 21 and 22, which are adjacent to the rear wall 20. The side walls 21 and 22 may be oriented essentially perpendicular to the rear wall 20, as shown in FIG. 13, 14. The side walls 21 and 22 are essentially vertically oriented. Moreover, the trough-shaped door body 18 has a bottom horizontal side wall 23 and has a top horizontal side wall 24. The trough-shaped door body 18 is configured as insert 12, which bounds the storage space 11 towards the rear side, towards the side, towards the bottom, and towards the top.

The door device 5 comprises a cover 25 that is separate from the trough-shaped door body 18. This separate cover 25 is formed as a single piece, in particular from plastic. The cover 25 in the embodiment is equally designed to be trough-shaped. It comprises a rear wall, which is formed as trough bottom 26. The cover 25 is designed in such a way that it covers the trough-shaped door body 18, viewed in the depth direction (z direction), towards the back, in particular fully covers it. Towards the compartment 3 the wall body 18 thus is fully covered by the cover 25.

As can also be seen in FIG. 3 and FIG. 4, the trough-shaped door body 18, viewed in the depth direction, plunges into the volume of the trough-shaped cover 25. Nevertheless, the rear wall 20 and the trough bottom 26, which is equally configured as rear wall, are arranged spaced apart from each other.

The cover 25 in the embodiment also represents an inner door wall 27, which covers the inner door 9 towards the back and thus is a rear end part. In particular is this inner door wall 27 thus also a rear visible component of the inner door 9. In the shown embodiment this inner door wall 27, which represents the cover 25 for the trough-shaped door body 18, is also a rear end part of the door device 5.

The cover 25 comprises side walls 28 and 29 ending in the trough bottom 26, which are vertical side walls. The inner face 13 (facing the compartment 3) is the inner face of the trough bottom 26. Thus, on the cover 25 the further door tray 14 is attached.

The further door tray 14 is arranged on the side of the door device 5 facing away from the storage space 11. The further door tray 14 is external to the storage space 11 or separated from the storage space 11. In the closed state of the inner door 9 in relation to the compartment 3, the further door tray 14 is arranged to face the compartment 3. In this case, the further door tray 13 may extend into the compartment 3. If the inner door 9 is in a closed state in relation to the compartment 3, the further door tray 14 is exposed to the storage conditions prevailing in the compartment 3.

The cover 25 thus is arranged on the side of the trough-shaped door body 18 opposite the access opening 17. This cover 25 covers the trough-shaped door body 18 on the side facing away from the outer door 10.

As can equally be seen in FIG. 2 to FIG. 4, the w trough-shaped door all body 18 and the cover 25, which is separate therefrom, are components of the inner door 9. In particular, the cover 25 and/or the trough-shaped door body 18 is arranged on a support structure 30 of the door device 5, in particular the inner door 9. The support structure 30 is preferably a frame. In particular, the frame is configured to be circumferentially closed.

Moreover, on the trough-shaped door body 18 in the storage space 11 a further, separate door tray 88 is arranged.

Figure 5:
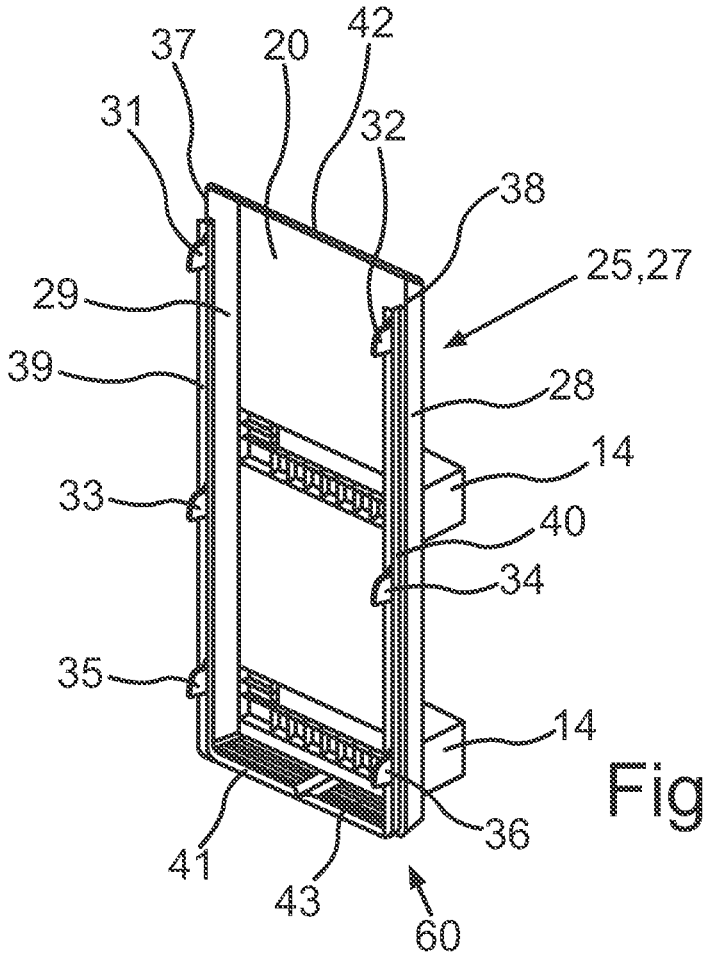
FIG. 5 a perspective view of a cover or an inner door wall of the door device.

FIG. 5 shows a perspective view an embodiment of the cover 25. The cover 25, as it is already set out in the above, can preferably be configured as inner door wall 27 for a door, here in particular the inner door 9.

On the vertically oriented side walls 28 and 29, which are situated opposite in the height direction, a plurality of suspension hooks 31, 32, 33, 34, 35, and 36 are formed, here in particular six. The suspension hooks 31 to 36 are integrated into the side walls 28 and 29. Preferably, at least two such suspension hooks 31 to 36 are present. In the embodiment shown here suspension hooks 31 to 36 are formed in pairs at the same height level. Preferably, it is envisaged that the suspension hooks 31 to 36 are configured to project from the side walls 28 to 29. They are freely cantilevering and in this connection oriented to face away from the rear wall 20.

Preferably, it is envisaged that on free vertical edges 37 and 38 of the side walls 28 and 29 carrier bars 39 and 40 are configured. The carrier bars 39 and 40 are designed as ribs and integrally formed with the side walls 28 and 29. On the carrier bars 39 and 40 projecting from the vertical edges 37 and 38 towards the front the suspension hooks 31 to 36 are integrally formed.

With the suspension hooks 31 to 36 the cover 25 is suspended from a component of the door device 5. In particular, a suspension from the top from the support structure 30 is achieved. This support structure 30, as already mentioned in the above, at least in portions is configured as at least U-shaped carrier frame, preferably circumferentially closed carrier frame.

Moreover, it can also be seen that the cover 25, which here in the shown embodiment is trough-shaped, comprises a further bottom side wall 41 and a further top side wall 42. By the side walls 28, 29, 41 and 42 thus also the trough is configured to be circumferentially closed. In the bottom side wall 41, which is oriented in the width direction, in an advantageous embodiment ventilation opening 43 are formed. These ventilation openings 43 are here configured to be ventilation slots. On the top side wall 42 equally ventilation openings 44 may be formed, which are configured as ventilation slots.

The ventilation openings 43 and 44 may additionally be connected with crossbars that are not shown here. These crossbars 45 are shown in an exemplary way in FIG. 6.

Moreover, it is preferably shown that the ventilation openings 43 and 44 are bounded by slanted walls so that the respective depth (viewed perpendicular to the sidewall 41, 42) of the ventilation openings is enlarged. The depth measured in the direction of the current then is not only given by the wall thickness of a side wall 41, 42, but by the bounding walls, which in this respect are extended.

By these ventilation openings 43, 44 a clearance 46 (FIG. 3 and FIG. 4), which is formed between the cover 25, here in particular air flows through the inner door wall 27, and the trough-shaped door body 18, in particular the body 19. Thereby a condensation in this clearance 46 can be avoided. Moreover by such an air flow in the clearance 46 an individual admission of temperature can be effected.

The cover 25 and in particular the inner door wall 27 may be integrally formed, in particular from plastic. The cover 25 may be formed as an injection-molded component. Such an injection-molded component may be manufactured by a cascade injection-molding.

In an embodiment, the trough-shaped door body 18 is attached in a non-destructively releasable way on the support structure 30. In this case, at least one screw connection may be applied. The cover 25 and also the inner door wall 27 is attached in a non-destructively releasable way directly on the trough-shaped door body 18. Here at least one screw connection can be provided. In particular it is envisaged that the cover 25 is suspended from the support structure 30 and additionally the cover 25 is screwed onto the trough-shaped door body 18.

The trough-shaped door body 18, viewed in the depth direction (z direction) of the door device 5, at least in portions is arranged to plunge into the cover 25, as it can be seen in FIG. 3 and FIG. 4. The clearance 46 is in particular also formed between the rear wall 20 of the trough-shaped door body 18 and also between a rear wall of the cover 25. In the embodiment this rear wall is formed by the trough bottom 26.

Figure 7:
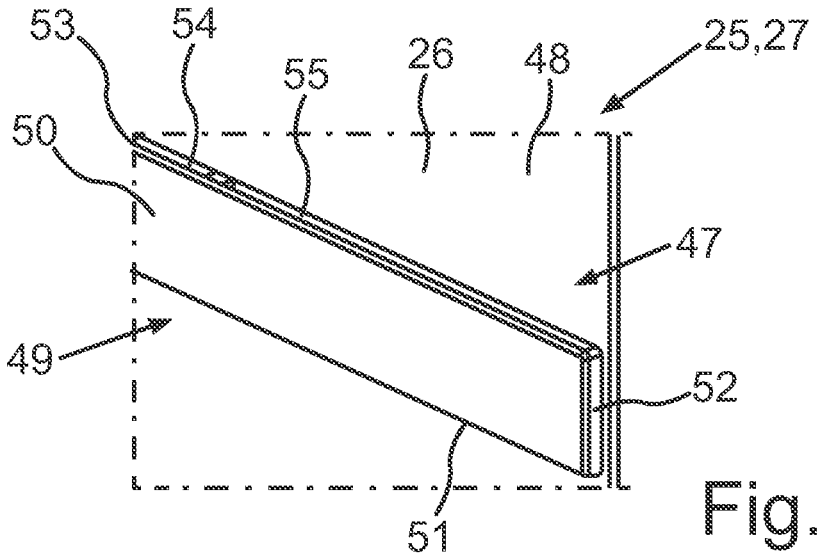
FIG. 7 a perspective view of a partial portion of an inner door wall with a representation of a suspension rib.

In particular, the cover 25 and also the inner door wall 27 comprise an integrally formed suspension rib 47, as it is shown in FIG. 7. The suspension rib 47 thus integrally manufactured with the inner door wall 27 is configured for suspending a door tray that is separate therefrom, in particular the door tray 14. As can be seen in FIG. 7, by the wall bottom 26, which here represents an embodiment for a wall element 48 of the inner door wall 27, this suspension rib 47 is formed as a single piece with it. This wall element 48 is oriented in the vertical direction and in the x-y plane.

In the representation in FIG. 7 it can be seen that this suspension rib 47 is oriented in the width direction and represents a plateau 49 that is elevated relative to the wall element 48. This plateau 49 thus can also be referred to as pedestal or base. This plateau 49 has a plane plateau front wall 50. This may extend in a plane parallel to the plane of the wall element 48.

By narrow plateau edges, namely in particular a bottom plateau edge 51, lateral plateau edges 52 and 53 and a top plateau edge 54, the elevated structure is formed and the connection to the wall element 48 achieved. Viewed in a direction perpendicular to the plane of the wall element 48 and thus in the depth direction, the plateau 49 preferably has a height smaller than 3 cm, in particular between 1 cm and 3 cm. The, viewed in the height direction, top plateau edge 54, which extends in the width direction, has a suspension slot 55. In this suspension slot 55, which is fully pass-through and thus is also configured as a slot hole, the further door tray 14 can be suspended from the top. This suspension slot 55 thus is open towards the top, viewed in the height direction. The suspension slot 55 thus is also a breach in the wall element 48 so that the further door tray 14 in the suspended state projects through the wall element 48. The further door tray 14 thus projects through the wall element 48 and is arranged in the mounted state on both sides of the wall element 48.

As can be seen in FIG. 7, the suspension slot 55 only in portions extends beyond the length of the top plateau edge 54 dimensioned in the width direction.

The lateral plateau edges 52 and 53 are configured to be of an uninterrupted design. In particular, also the bottom plateau edge 51 is of an uninterrupted design. The lateral plateau edges 52 and 53 directly end in the bottom plateau edge 51 so that here a U-shaped plateau edge construct is formed, which is designed to be uninterrupted and without a slot.

The plateau 49 is of a single-wall design so that a rear side 56 (FIG. 8) of the plateau 49 forms a partial area of a rear wall of the wall element 48.

The suspension rib 47 on its rear side 56 preferably comprises a multitude of couple bars 58 that are formed as a single piece with the suspension rib 47. This can be seen in the perspective sectional view in FIG. 8. In FIG. 9 in this connection a view of the couple bars 58 is shown, which preferably is configured as truss structure 57.

Figure 8:
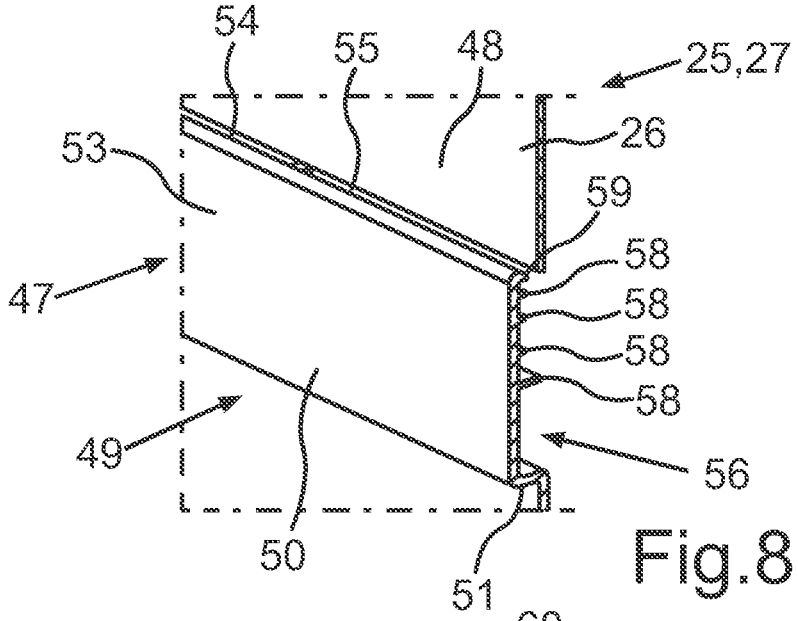
FIG. 8 a vertical sectional view through the inner door wall according to FIG. 7.
Figure 9:
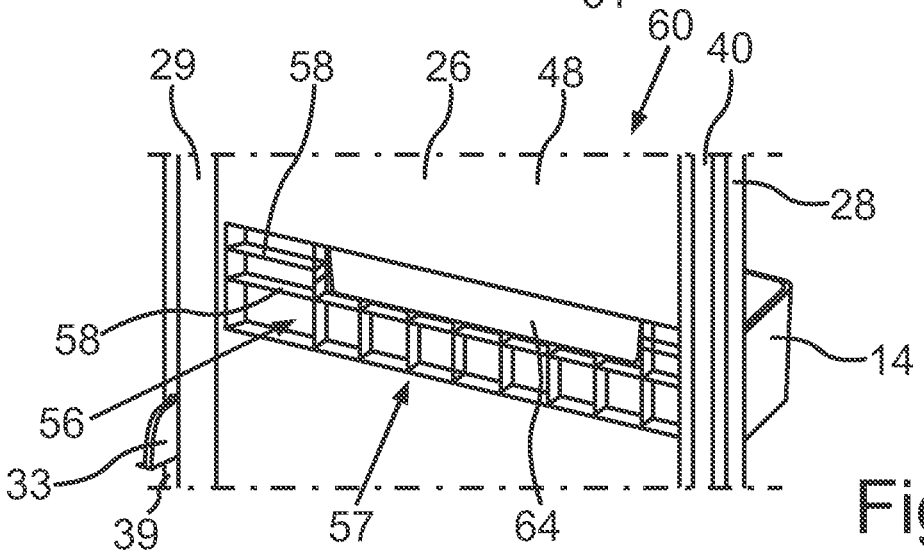
FIG. 9 a further view of the inner door wall from a side that is opposite to FIG. 7 and FIG. 8, wherein in FIG. 9 a door tray is suspended from a suspension rib, as it is configured integrated in the inner door wall.

As can be seen in FIG. 8 and FIG. 9, these couple bars 58 are configured to project from the rear side 56. It may be envisaged, as this is shown in FIG. 8, that in a direction perpendicular to this rear side 56 the couple bars 58 have different dimensions. For instance a couple bar 58 that is further spaced apart from the suspension rib 55 towards the bottom can extend with a larger length away from the rear side 56 than a couple bar 58 arranged in the height direction above it. By the couple bars 58, in particular if they have different lengths in a direction perpendicular to the rear side 56, also a clamping structure or jamming structure for the further door tray 14 can be formed. Thereby upon suspending also a clamping or jamming holding of the further door tray 14 to the suspension rib 47 can be facilitated. Moreover, by the couple bars 58 also a stiffening of the suspension rib 47 is achieved.

Moreover in FIG. 8 it can also be seen that the suspension slot 55 is formed in a direction perpendicular to the wall element 48 not across the entire dimensions of the top plateau edge 54, but is narrower. Thereby a transition 59 is formed, which is not present as narrow, sharp edge, but as rounded roof bar.

Figure 6:
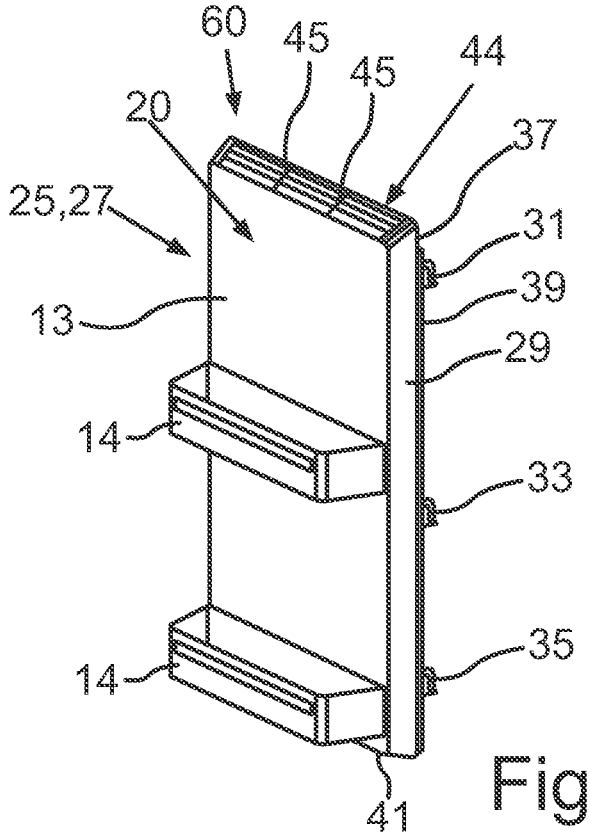
FIG. 6 the cover according to FIG. 5 in a perspective that is different therefrom.
Figure 10:
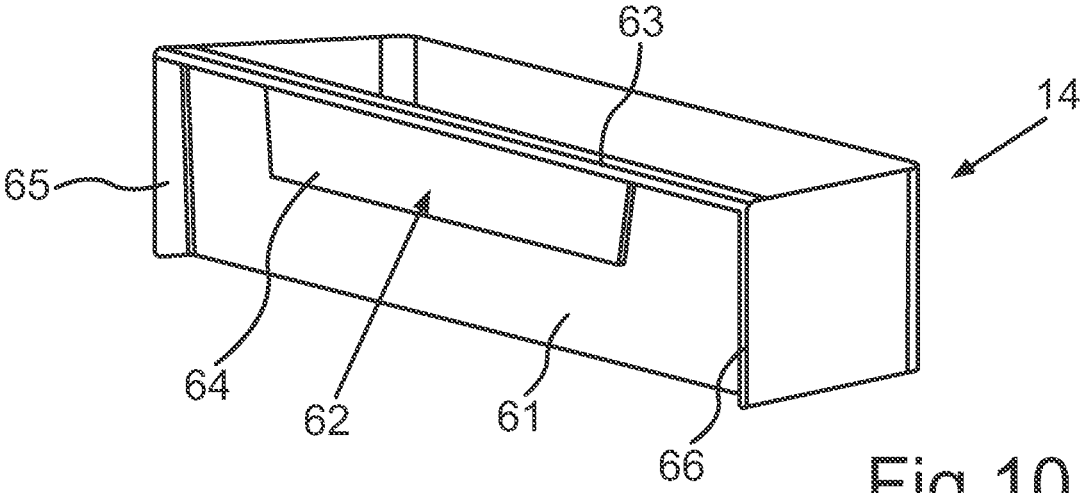
FIG. 10 a perspective view of an embodiment of a door tray, as it is suspended from an inner door wall according to FIG. 9.

In FIGS. 5, 6, and 9 also an arrangement 60 is shown, which comprises the inner door wall 27 and the further door tray 14. An exemplary further door tray 14, as it can be installed on the inner door wall 27, is shown in FIG. 10. The further door tray 14 on a rear wall 61 comprises a suspension element 62 that is formed as a single piece with it. This is here configured to be rib-like or strip-like. It extends in an L-shape from the rear wall. It comprises a roof bar 63 and a leg 64 that is vertically oriented relatively thereto. As can be seen in FIG. 9, the vertical leg 64 extends through the suspension rib 55 from the top. With this leg 64 thus the further door tray 14 engages behind the inner door wall 27. The roof bar 63 rests on the top plateau edge 54, in particular the transition 59 and thus also the suspension rib 47 from the top. Thus the leg 64 is arranged spaced apart from the rear wall 61.

The further door tray 14 may comprise distance bars 65 and 66. These extend to project from the rear wall 61. These distance bars 65 and 66 in the width direction are spaced from each other in such a way that they contact the wall element 48 laterally of the suspension rib 47 in the mounted state of the further door tray 14. In particular here essentially, viewed in the width direction, a precisely fitting receiving of the suspension rib 47 is facilitated. Thereby the fit of the further door tray 14 on the inner door wall 27 in the suspended state is improved. In particular, a slipping in the width direction in an advantageous embodiment is thereby avoided. Additionally or alternatively, the leg 64 has a width that corresponds to the width of the suspension slot 55.

The further door tray 14 is formed as a single piece with the suspension element 62 and/or the distance bars 65 and 66. The arrangement 60 in an advantageous embodiment can be integral component of a door of a household cooling appliance 1. In the shown embodiment it is integral component of the inner door 9. In particular same is integral part of the door device 5.

Figure 11:
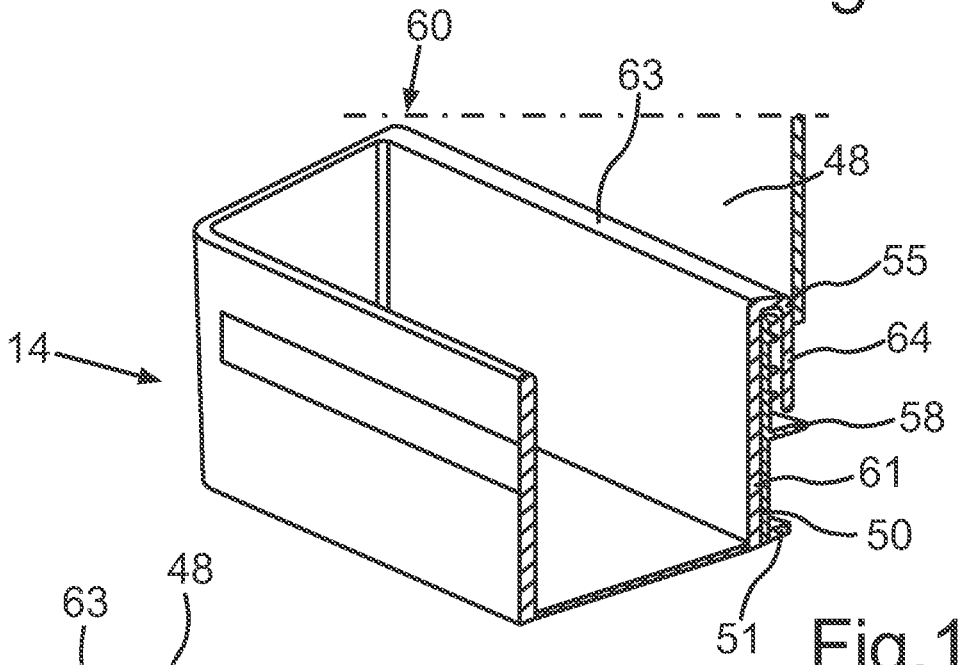
FIG. 11 a perspective sectional view of the door tray, as it is suspended from a suspension rib of the inner door wall.

In FIG. 11 in a perspective sectional view the arrangement 60 is shown. It can be seen here how the vertical leg 64 is inserted through the suspension slot 55 from the top and engages the wall element 48 from behind. In particular here a coupling with the couple bars 58 is shown so that preferably a clamping effect is achieved. Moreover it can also be seen that the rear wall 61 contacts the plateau front wall 50 laminar. The suspension rib 47, viewed in the height direction, is dimensioned in such a way that it has the height of the rear wall 61 or essentially this height. In the mounted state of the further door tray 14 the suspension rib 47 thus is fully covered by the door tray 14 at the front side.

Figure 12:
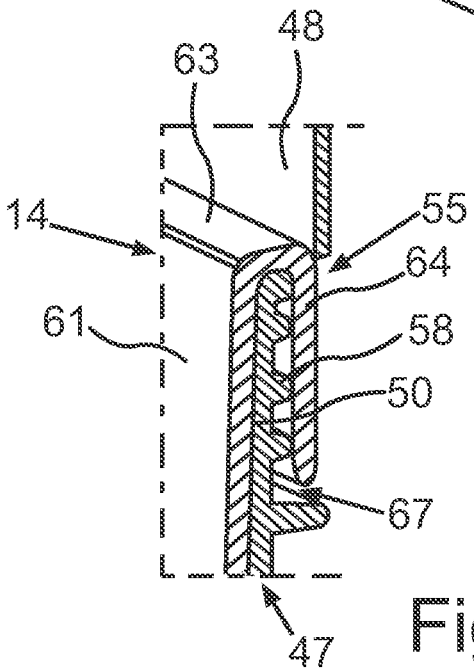
FIG. 12 an enlarged view of a partial portion of FIG. 11.

In FIG. 12 in an enlarged view a partial section from FIG. 11 is shown. The clamping attachment of the further door tray 14 on the suspension rib 47 can be seen. By the leg 64 and the rear wall 61 a slot or a groove 67 is formed, into which then the plateau front wall 50 and the couple bars 58 plunge.

Figure 14:
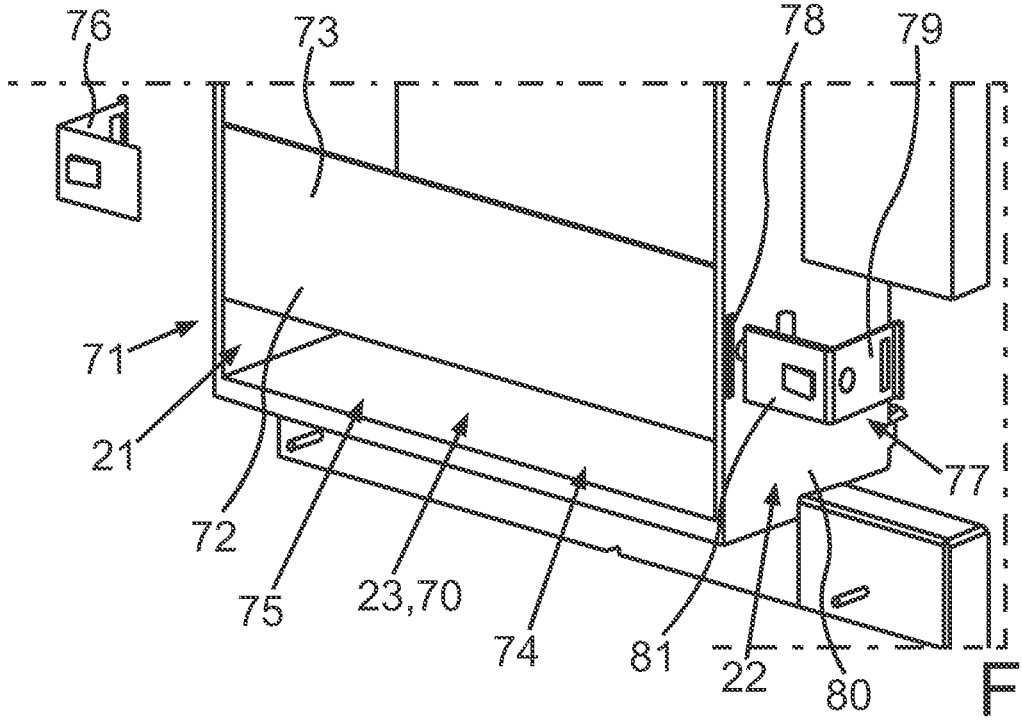
FIG. 14 an enlarged view of a rear partial portion of the representation in FIG. 13, wherein also a door tray with a front wall as separate component and two separate holding brackets is shown.

FIG. 13 shows a perspective view of the trough-shaped door body 18, which here forms a body 19 of a door insert. The trough-shaped door body 18 at its top side wall 24 preferably comprises ventilation openings 68. Additionally or alternatively, the trough-shaped door body 18 may comprise ventilation openings 69 at its bottom side wall 23. The bottom side wall 23, viewed in the height direction, forms a bottom. The bottom may be the bottom of a door tray. The door tray, as shown in FIG. 13 and FIG. 14, is formed by the door insert 71 comprising the body 19, the bottom 23, side walls 21 and 22 as well as a front wall. The front wall 72 is here formed by a separate component 73. The door tray comprises a storage space 74, in particular for bottles. In the shown embodiment the door tray is formed by the trough-shaped door body 18 and the separate component 73. Therefore, the door tray is integrated with partial components into the inner door 9. Parts of the door tray are multifunctional components, since they in addition to forming a storage space 74 also have at least one further function, in particular bound the storage space 11. In particular, a partial volume of the storage space 11 is formed by the storage space 74. The separate component 73 may be a board-like or beamlike element. The separate component 73 may be a straight, rectangular plate. The separate component 73 may extend into one plane. In the present embodiment, the separate component 73, viewed in the height direction, is arranged spaced apart from the bottom 70 so that between the bottom 70 and the separate component 73 an air gap 75 is formed.

The separate component 73 is connected at its opposite ends with the side walls 21 and 22 and extends across the entire storage space 11, i.e. the clear width between the side walls 21 and 22. It may be referred to the separate component 73 also as connection bar which extends between the sidewalls 21 and 22.

The front wall 72, which is configured as separate component 73, is fastened by at least one separate holding bracket. In the present embodiment, two separate holding brackets 76 and 77 are applied, as shown in FIG. 14. In the present embodiment, the separate holding brackets 76 and 77 are of an L-shaped design. The separate holding brackets 76 and 77 may be formed each as single-pieces. As can be seen in the figures, the side wall 22 has a through hole 78, which here is configured to be slot-like. The through hole 78 is fully circumferentially surrounded by material of the side wall. Therefore, through hole forms an annual opening within the side wall 22. The description of the separate holding bracket 76 applies analogously to the separate holding bracket 77 and vice versa in view of the description above and below. The holding bracket 77 extends through the through hole 78 in the mounted state. Analogously, the same applies to the further (left) side wall 21, which also comprises such a through hole, through which the further separate holding bracket 76 extends.

In the mounted state, the separate holding bracket 77 extends on both sides of plate-like side wall 22. The separate holding bracket 77 comprises a first bracket element 79. This first bracket element 79 in the mounted state of the separate holding bracket 77 contacts an outer face 80 of the side wall 22. This outer face 80 is the side, which faces away from the opposite side wall 21, and thus also faces away from the storage space 74. This first bracket element 79 contacts this surface 80 laminar. In other words, the at least one separate holding bracket 76, 77 comprises a first bracket element 79, wherein the first bracket element 79 contacts the outer face 80 of the side wall 21, 22.

Figure 15:
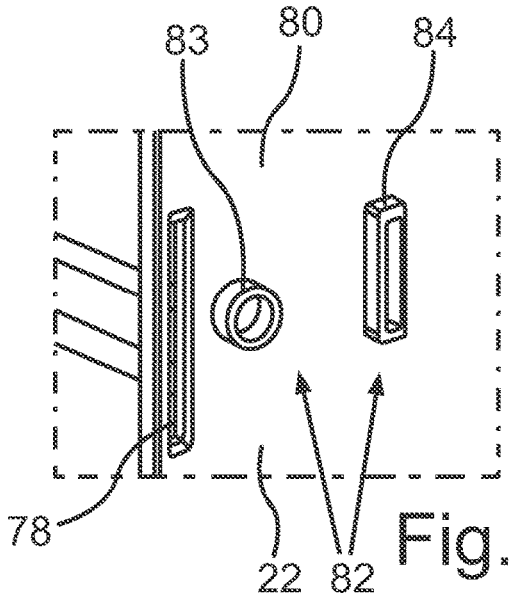
FIG. 15 an enlarged partial section of the side wall of a body of the door tray, wherein the body is formed by the trough-shaped door body.
Figure 16:
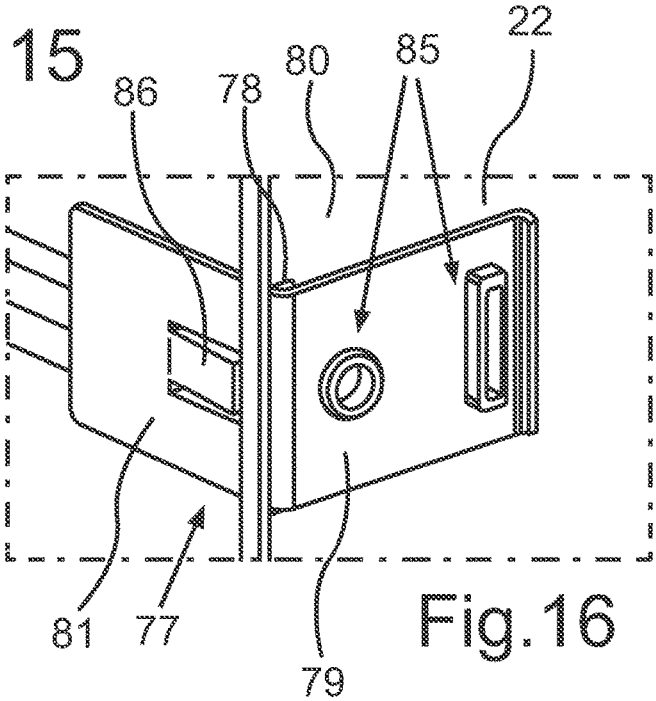
FIG. 16 the view according to FIG. 15 with a separate holding bracket mounted thereon.

The separate holding bracket 77 comprises a second bracket element 81, which ends in the first bracket element 79, in particular at an angle of 90°. In the mounted state, the second bracket element 81, which is oriented in the width direction, extends through the through hole 78 and is coupled with the separate component 73. The second bracket element 81 may be a couple blade. As can be seen in FIG. 14, and FIG. 15, at this outer face 80 a coupling structure 82 is formed. This coupling structure 82 in the present embodiment comprises two differently shaped coupling elements 83 and 84, which are integrated into the outer face 80. In particular, a complementary counter coupling structure 85 is formed in the first bracket element 79, as it can be seen in the enlarged view in FIG. 16. In the mounted state, the separate holding bracket 77, as shown in FIG. 16, the coupling structure 82 is coupled with the counter coupling structure 85. For this purpose the coupling elements 83 and 84 plugged into the corresponding counter coupling elements in the first bracket element 79. In particular, the coupling elements 83 and 84 extend through the counter coupling elements of the counter coupling structure 85 that are configured as respective holes.

In other words, the outer face 80 of a side wall 21, 22 is provided with a coupling structure 82, wherein the first bracket element 79 of the separate holding bracket 76, 77 is provided with a counter coupling structure 85, wherein the coupling structure 82 and the counter coupling structure 85 are engaged with each other.

Further, the coupling structure 82 comprises at least two coupling elements 83, 84 being integrally formed on the side wall 21, 22.

Also, the counter coupling structure 85 are provided by two openings, wherein the two coupling elements 83, 84 are projecting beyond the openings in the direction normal to the face of the side wall 21, 22.

FIG. 16 shows the mounted final state of the separate holding bracket 77 on the side wall 22. The second bracket element 81 extends through the through hole 78.

In other words, the at least one side wall 21, 22 comprises a through hole 78, wherein the separate holding bracket 76, 77 being plugged in the through hole 78 and partly inserted into a hollow section 87 of the front wall 72, as seen in FIGS. 13 to 19.

At least one clamping element 86 is formed in the second bracket element 81. In particular, the clamping element 86 may be integrally formed in the second bracket element 81. The clamping element 86 may be a spring element, which partly projects from a side face the first bracket element 81.

In other words, the second bracket element 81 comprises a clamping element 86 being integrally formed with the second bracket element 81 as a single piece. In particular, the camping element 86 may be inserted into the hollow profile 87.

Further, the clamping element 86 may be a spring element that projects from a main plane of the second bracket element 81, as shown in FIG. 16.

Figure 19:
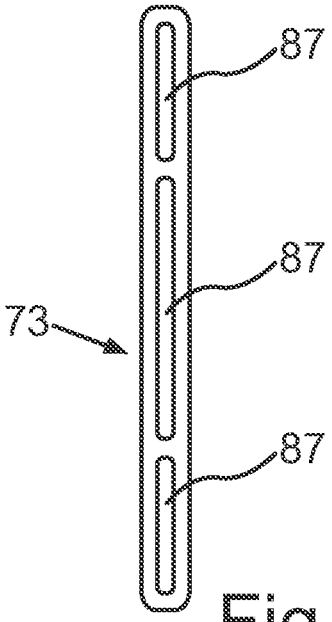
FIG. 19 a lateral view of an embodiment of the front wall.

The separate component 73 is at least partly configured to comprise a hollow profile 87 (FIG. 19). In particular, the sideward ends of the separate component 73 are provided with hollow profiles 87 for coupling with the separate holding brackets 76 and 77. In other words, the hollow profiles 87 are formed and open towards the side of the front wall 72. Upon mounting the separate component 73, the first bracket element 81 is inserted into the hollow profile 87.

Figure 17:
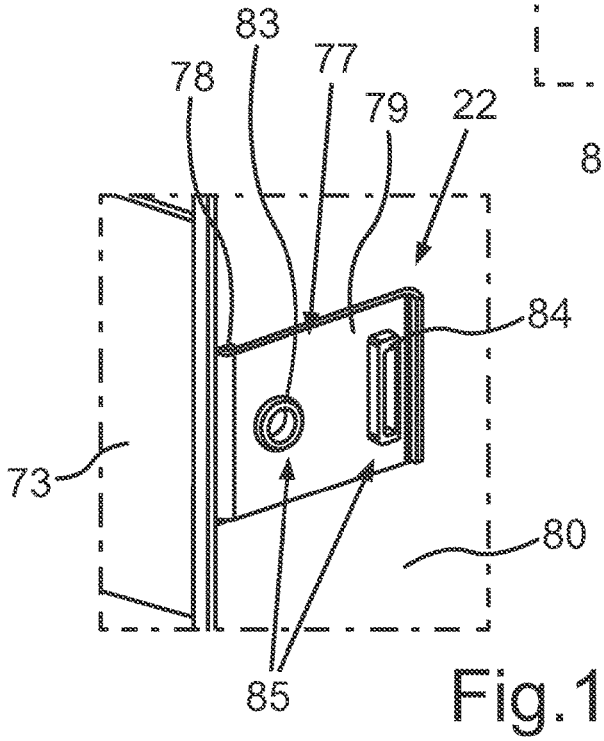
FIG. 17 the view according to FIG. 16 with front wall connected to the separate holding bracket.

With the clamping element 86 jamming clamping of the separate holding bracket 77 with the front wall 72 is achieved. FIG. 17 shows a mounted final state of the separate component 73 with the separate holding bracket 77. The second bracket element 81 is fully inserted into the hollow profile 87. The separate component 73 is arranged in such a way that, when viewed in the depth direction, it is flush with the front edge of the side wall 22 as well as with the front edge of the side wall 21.

Figure 18:
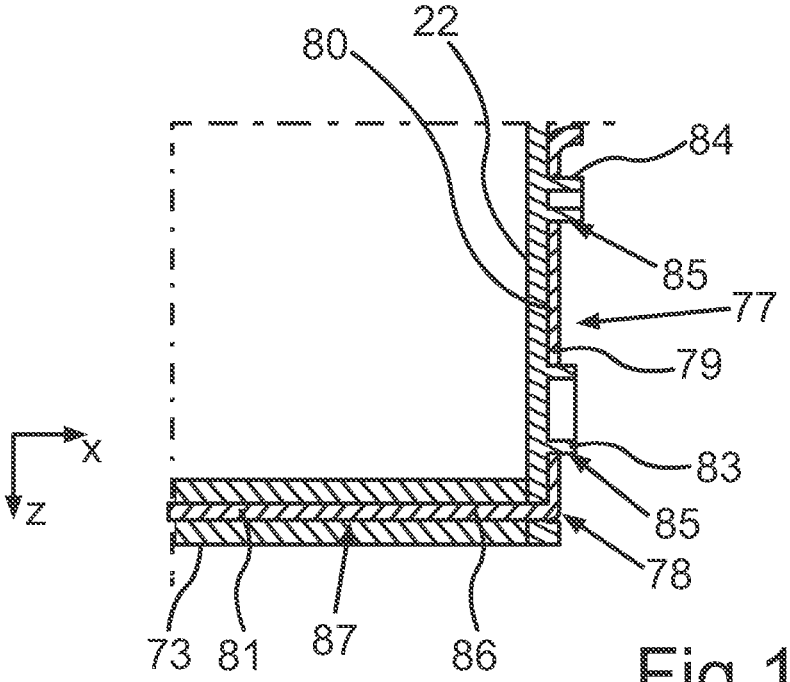
FIG. 18 a horizontal sectional view through the implementation in FIG. 17.

FIG. 18 shows a horizontal sectional view (sectional plane is the x-z plane) of in FIG. 17. It can be seen, how the second bracket element 81 is inserted into the hollow profile and a clamping by the use of the clamping element 86 is achieved.

FIG. 19 shows the end or end face of the separate component 73. The hollow profile 87, which is open at the end face, can be seen.

The front wall 72 or rather separate component 73, may be an extruded metal profile, in particular an extruded aluminum profile.

The following is a list of reference numerals used in the above description and in the drawing figures:

1 household cooling appliance
2 housing
3 compartment
4 (first) door
5 door device
6 door tray
7 compartment
8 (second) door
9 inner door
10 outer door
11 storage space
12 insert
13 inner face
14 further door tray
15 viewing pane
16 frame
17 access opening
18 door body
19 body
20 rear wall
21 left side wall, side wall

22 right side wall, side wall
23 bottom wall, side wall
24 top wall, side wall
25 cover
26 rear wall
27 inner door wall
28 side wall
29 side wall
30 support structure
31 suspension hook
32 suspension hook
33 suspension hook
34 suspension hook
35 suspension hook
36 suspension hook
37 vertical edge
38 vertical edge
39 carrier bar
40 carrier bar
41 side wall
42 side wall
43 ventilation opening
44 ventilation opening
45 crossbar
46 clearance
47 suspension rib
48 wall element
49 plateau
50 plateau front wall
51 plateau edge
52 plateau edge
53 plateau edge
54 plateau edge
55 suspension slot
56 rear side
57 truss structure
58 couple bars
59 transition
60 arrangement
61 rear wall
62 suspension element
63 roof bar
64 leg
65 distance bar
66 distance bar
67 groove
68 ventilation opening
69 ventilation opening
70 bottom
71 door insert
72 front wall
73 separate component
74 storage space
75 air gap
76 separate holding bracket
77 separate holding bracket
78 through hole
79 separate bracket element
80 outer face
81 separate bracket element
82 coupling structure
83 coupling element
84 coupling element
85 counter coupling structure
86 clamping element
87 hollow profile
88 door tray

The invention claimed is:

1. A door insert for a door of a household cooling appliance, the door insert comprising:

a body defining a storage space for storing goods, said body having a bottom and side walls, and at least one of said side walls being formed with a through hole;

at least one front wall extending in a width direction between said side walls, said at least one front wall being a non-destructively releasable separate component; and at least one separate holding bracket connecting said separate component to at least one of said side walls, said at least one separate holding bracket having a first bracket element extending in a depth direction configured to contact an outer face of said at least one of said side walls and a second bracket element extending in said width direction enclosing with said first bracket element an angle between 80° and 100°, wherein said second bracket element is plugged in said through hole and at least partly inserted in a hollow section formed in said front wall in the width direction;

said second bracket element having a clamping element integrally formed with said second bracket element as a single piece, and said clamping element being inserted into the hollow section.

2. The door insert according to claim 1, wherein said first and second bracket elements enclose an angle of 90°.

3. The door insert according to claim 1, wherein said at least one of said side walls has said outer face formed with a coupling structure, said first bracket element of said at least one separate holding bracket is formed with a counter coupling structure, and wherein said coupling structure and said counter coupling structure are engaged with one another.

4. The door insert according to claim 3, wherein said coupling structure comprises at least two coupling elements being integrally formed on said at least one of said side walls.

5. The door insert according to claim 4, wherein said counter coupling structure is two openings, and said at least two coupling elements project beyond said two openings in a direction normal to a face of said at least one of said side walls.

6. The door insert according to claim 1, wherein said clamping element is a spring element that projects from a main plane of said second bracket element.

7. The door insert according to claim 1, wherein said front wall is an extruded metal profile.

8. The door insert according to claim 7, wherein said front wall is an extruded aluminum profile.

9. The door insert according to claim 1, wherein said body is an insert.

10. A door for a household cooling appliance, the door comprising:

a door insert according to claim 1;

said body of said door insert is a frame inserted into an opening or recess of the door; and wherein said at least one front wall is one of a plurality of front walls connected to said side walls of said body.

11. The door according to claim 10, which comprises an inner door and an outer door arranged in front of said inner door in a closed state thereof, and wherein said door insert is inserted into an opening or recess of said inner door.

12. A household cooling appliance, comprising a door with a door insert according to claim 1.

13. A method of mounting a door insert for a door of a household cooling appliance, the method comprising:

providing a door insert with a body forming a storage space for stored goods, the body including a bottom and side walls and at least one of the side walls is formed with a through hole;

providing a separate component to form a front wall of the storage space extending in a width direction between the side walls; and providing at least one separate holding bracket with said at least one separate holding bracket having a first bracket element extending in a depth direction and a second bracket element extending in the width direction enclosing with the first bracket element an angle between 80° and 100°;

providing the second bracket element with a clamping element integrally formed with the second bracket element as a single piece;

non-destructively releasably attaching the front wall to at least one of the side walls with said at least one separate holding bracket, where said first bracket element engages or contacts an outer face of the at least one of the side walls and, wherein the second bracket element is plugged in the through hole and is at least partly inserted in a hollow section formed in the front wall in the width direction, and thereby inserting the clamping element into the hollow section.

14. A door insert for a door of a household cooling appliance, the door insert comprising:

a body defining a storage space for storing goods, said body having a bottom wall and side walls, each of said bottom wall and side walls having an outer wall face and an inner wall face, said inner wall faces delimit said storage space, and each of said side walls being formed with a through hole which extends from said outer wall face to said inner wall face;

at least one non-destructively releasable front wall, said front wall having an outer wall face and an inner wall face, where said inner wall face of said front wall delimits said storage space, a hollow section formed between said outer wall face and said inner wall face at each end of said front wall in a width direction, said front wall extending between said side walls in said width direction;

a first separate holding bracket connecting said front wall to one of said side walls, a second separate holding bracket connecting said front wall to the other of said side walls;

each of said first and second separate holding brackets having a first bracket element extending in a depth direction configured to contact said outer wall face of respective said side walls; and a second bracket element extending in said width direction enclosing with said first bracket element an angle between 80° and 100°, and said second bracket element being received in respective said through holes and received in respective said hollow sections of said front wall;

said second bracket element having a clamping element integrally formed with said second bracket element as a single piece, and said clamping element being inserted into the hollow section.

* * * * *